US005952263A

United States Patent [19]

Suzaki et al.

[11] Patent Number: 5,952,263

[45] Date of Patent: Sep. 14, 1999

[54] TRANSPARENT THERMOSENSITIVE RECORDING MATERIAL

[75] Inventors: Hideo Suzaki, Numazu; Hideo Aihara, Fuji, both of Japan

[73] Assignee: Ricoh Company, Ltd., Tokyo, Japan

[21] Appl. No.: 08/953,425

[22] Filed: Oct. 17, 1997

Related U.S. Application Data

[60] Provisional application No. 60/030,383, Nov. 5, 1996.

[30] Foreign Application Priority Data

Oct. 22, 1996 [JP] Japan ..... 8-298127
Oct. 7, 1997 [JP] Japan ..... 9-290501

[51] Int. Cl.[6] ..... B41M 5/40

[52] U.S. Cl. ..... 503/200; 427/152; 428/212; 503/201; 503/207; 503/226

[58] Field of Search ..... 427/150–152; 428/212; 503/200, 201, 207, 226

[56] References Cited

U.S. PATENT DOCUMENTS 5,229,349 7/1993 Kurisu et al. ..... 503/200
5,447,900 9/1995 Suzaki et al. ..... 503/207
5,482,911 1/1996 Hiroshi et al. ..... 503/200
5,482,912 1/1996 Furuya et al. ..... 503/207

FOREIGN PATENT DOCUMENTS 6166265 6/1994 Japan ..... 503/226
7076168 3/1995 Japan ..... 503/226

*Primary Examiner*—Bruce H. Hess
*Attorney, Agent, or Firm*—Cooper & Dunham LLP

[57] ABSTRACT

A transparent thermosensitive recording material is provided which includes a transparent substrate, a thermosensitive recording layer formed on the substrate, and a protective layer which is formed on the thermosensitive recording layer and including a resin, wherein the protective layer has a microscopically rough surface with projections and pits in which a 95% confidence interval of a distribution of a number of sections of projections in a depth direction of the surface of the protective layer is less than about 0.5 $\mu$m and a maximum number of the sections in the distribution of the number of sections is from about 100 to about 500 per 1000 $\mu m^2$ when the surface of the protective layer is horizontally cut 41 times at equally spaced intervals between a top of a maximum projection of the surface and a bottom of a maximum pit of the surface of the protective layer. The transparent thermosensitive recording material has high transparency, good image qualities without undesirable white streaks and good ability to be used with thermal printheads without sticking to the thermal printheads.

17 Claims, 2 Drawing Sheets

TRANSPARENT THERMOSENSITIVE RECORDING MATERIAL

This is a provision application Ser. No. 60/030,383 filed Nov. 5, 1996.

BACKGROUND OF THE INVENTION

1. Field of the Invention

The present invention relates to a transparent thermosensitive recording material, and more particularly to a transparent thermosensitive recording material which forms a colored image upon application of heat thereto and which has high transparency, good image qualities and good ability to be used with thermal printheads.

2. Discussion of the Related Art

A variety of recording materials have been proposed in which a colored image is formed upon application of heat, pressure or the like thereto. Among these recording materials, thermosensitive recording materials are well known which can form a colored image by a chemical coloring reaction when a colorless or a pale-colored coloring agent, such as an electron donor, e.g., a leuco dye having a lactone, a lactam or a spiropyran ring, is brought into contact with a coloring developer, such as an electron acceptor, e.g., an organic acid or a phenolic compound, while heat, pressure or the like is applied thereto.

These thermosensitive recording materials generally include a thermosensitive recording layer (hereinafter referred to as a recording layer) which is formed on a substrate and includes a coloring agent and a coloring developer, and optionally include a protective layer which is formed on the recording layer.

The thermosensitive recording materials have the following advantages over other conventional recording materials:

(1) color images can rapidly be recorded by a relatively simple apparatus without using such complicated steps as developing and fixing;

(2) color images can be recorded without producing noise and environmental pollution;

(3) various color images, e.g., red, blue, violet and black, can easily be obtained;

(4) image density and background whiteness are high; and (5) the manufacturing cost is low.

Because of these advantages, the above-described thermosensitive recording materials can be widely used, not only as a recording material for price labels in stores, but also as recording materials for copiers, printers for computers, facsimiles, automatic vending machines of labels and tickets, video printers and measuring instruments.

Recently, in the medical field or the like, a transparent recording material which can easily produce an image using a dry developing process without environmental pollution has become desired since photographic recording materials using silver halide which have been used as recording materials for radiography have waste-disposal problems of the developing liquid. In addition, a transparent recording material is also desired which can easily produce an image by a method using digital signal image processing which has become widely employed in recent years. Thermal recording is suitable as a recording process for radiography because of having the above-mentioned advantages; therefore, a transparent thermosensitive recording material is needed to serve as transparent print output sheets for radiography printers or the like.

In thermal recording processes, thermal printheads have been widely used as a heating medium. The thermal printhead applies heat to a thermosensitive recording material while contacting the surface of the thermosensitive recording material. When the surface of the recording layer of a thermosensitive recording material having high smoothness (because, for example, the recording layer is formed on a film substrate) is heated with a thermal printhead to record an image, the following problems tend to occur:

(1) sticking occurs in which the surface of the recording layer sticks to the thermal printhead because of the good contact of the recording layer and the thermal printhead, thereby deteriorating image qualities or feeding properties of the thermosensitive recording material;

(2) a part or a component of the recording layer is melted or softened and toughly adhered to the thermal printhead due to the heat applied for recording images, resulting in occurrence of undesirable white streaks in the recorded images because the part of the thermal printhead to which the extraneous substance is adhered has insufficient heat conduction; and (3) dust tends to be attracted to the surface of the thermosensitive recording material having the plastic film substrate and when a thermal printhead applies heat to the thermosensitive recording material on which the dust is adhered, the dust which tends to stay between the thermal printhead and the highly smoothed surface of the feeding thermosensitive recording material prevents the thermal printhead from contacting the surface of the feeding thermosensitive recording material, resulting in occurrence of undesired white streaks in the recorded images.

In attempting to solve these problems, i.e., sticking and white streaks, a thermosensitive recording material having a protective layer which includes a filler having a predetermined particle diameter has been disclosed (Japanese Laid-Open Patent Application No. 6-166265). However, this thermosensitive recording material has poor transparency and therefore cannot be used for purposes for which a transparent recording material is desired. Japanese Laid-Open Patent Application No. 7-76168 discloses a transparent thermosensitive recording material whose surface has a predetermined degree of smoothness. However, the latter transparent thermosensitive recording material does not have good ability to be used with thermal printheads.

Because of these reasons, a need exists for a transparent thermosensitive recording material having high transparency, good image qualities without white streaks and good ability to be used with thermal printheads without sticking to the thermal printheads.

SUMMARY OF THE INVENTION

Accordingly, an object of the present invention is to provide a transparent thermosensitive recording material having high transparency, good image qualities without white streaks and good ability to be used with thermal printheads without sticking to the thermal printheads.

To achieve such an object, the present invention contemplates the provision of a transparent thermosensitive recording material which has a transparent substrate, a recording layer formed on the substrate, and a protective layer formed on the recording layer, wherein the protective layer has a microscopically rough surface comprising projections including a maximum projection having a top and pits including a maximum pit having a bottom, such that when the surface is oriented horizontally and is horizontally cut in a plane at any level in a depth direction of the surface between the maximum projection top and the maximum pit bottom, the plane of cutting contains a number of sections of projections equal to the number of projections intersected by cutting at that level, and wherein the microscopically rough surface is a surface in which a 95% confidence interval of a distribution of a number of sections in the aforesaid depth direction is less than about 0.5 $\mu$m and a maximum number of sections in the distribution of the number of sections is from about 100 to about 500 per 1000 $\mu m^2$ when the surface is horizontally cut 41 times at equally spaced intervals between the maximum projection top and the maximum pit bottom.

It will be understood that the term "number of sections" means the number of sections of projections contained in one horizontal plane in which the surface is cut (with the microscopically rough surface oriented horizontally); thus the term "distribution of a number of sections in the depth direction" has reference to the value of the number of sections in different horizontal planes, i.e., at different levels, along the (vertical) depth direction.

The term "95% confidence interval" herein means a range of the depth of the surface of the protective layer in which are included sections equal in number to 95% of the total sections (i.e., 95% of the sum of all numbers of sections in a distribution); for example, if there are a total of 3000 sections when the surface of the protective layer is cut 41 times, the 95% confidence interval is a range of the depth of the surface in which 2850 (3000×0.95) of the sections are included.

Preferably, the 95% confidence interval of the distribution of the number of sections is from about 0.2 to about 0.35 $\mu$m and the maximum value of the number of sections in the distribution of the number of sections is from about 200 to about 400 per 1000 $\mu m^2$.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

The thermosensitive recording material of the present invention has a transparent substrate such as a plastic film, a recording layer formed on the substrate and a protective layer formed on the recording layer. The structure of the thermosensitive recording material of the present invention need not be limited to this structure. For example, an intermediate layer may be formed between the substrate and the recording layer, and a back layer may be formed on the side of the substrate opposite to the side on which the recording layer is formed. The recording layer includes, for example, a binder resin, a coloring agent and a coloring developer which forms a colored image by reacting with the coloring agent upon application of heat or the like. The protective layer is formed on the recording layer to make the thermosensitive recording material resistant to heat of a recording device such as a thermal printhead and to make the thermosensitive recording material and recorded images resistant to chemicals, water, light and rubbing.

By controlling the surface smoothness of the thermosensitive recording material while keeping the thermosensitive recording material transparent, a transparent thermosensitive recording material having high transparency, good image qualities without undesirable white streaks and good ability to be used with thermal printheads without sticking can be obtained.

The protective layer of the transparent thermosensitive recording material of the present invention preferably has a microscopically rough surface in which a 95% confidence interval of a distribution of a number of sections in a depth direction of the surface of the protective layer is less than 0.5 $\mu$m and a maximum number of the sections in the distribution of the number of sections is from about 100 to about 500 per 1000 $\mu m^2$ when the surface of the protective layer is microscopically and horizontally cut 41 times in at equally spaced intervals between a top of a maximum projection of the surface and a bottom of a maximum pit of the surface of the protective layer. In addition, the transparent thermosensitive recording material preferably has a Haze factor, which means degree of cloudiness of a sheet and which is measured by a method based on ASTM D1003 or ISO 3537, less than about 40%.

Figure 1A:
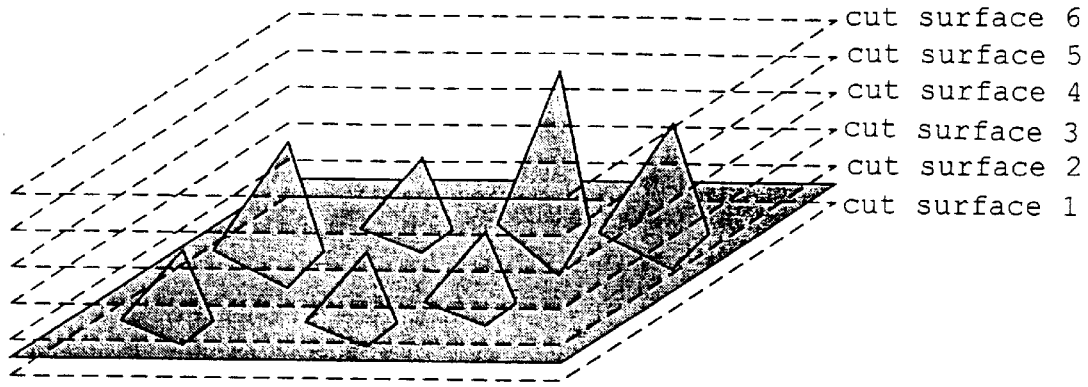
FIG. 1*a* is a schematic view illustrating how to determine a number of sections of a protective layer.
Figure 1B:
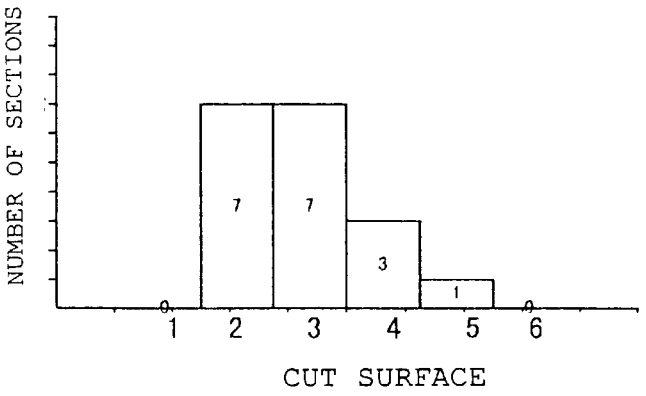
FIG. 1*b* is a distribution chart of the number of sections of the protective layer shown in FIG. 1*a*.
Figure 2:
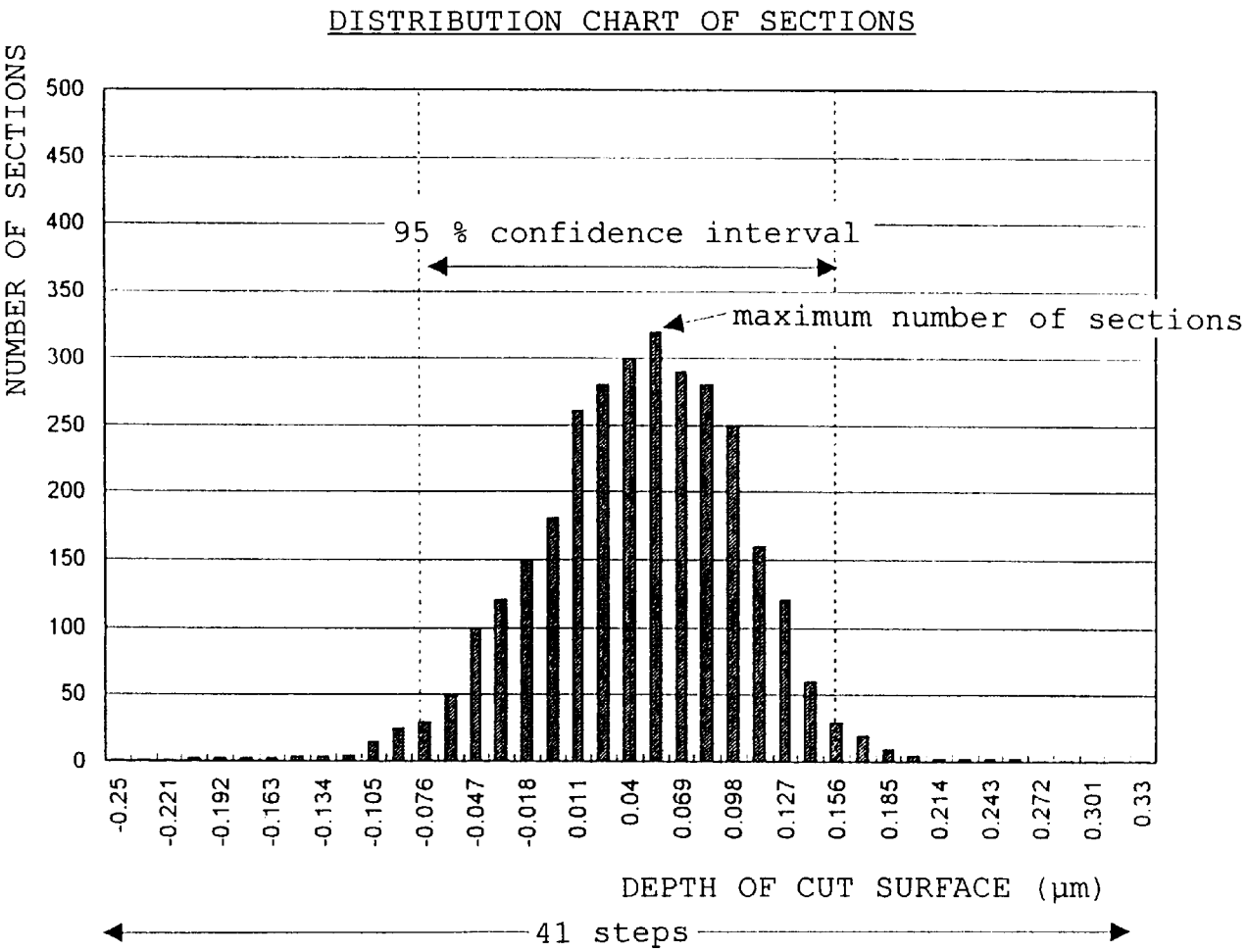
FIG. 2 is an example of a distribution chart of a number of sections of a protective layer.

As shown in FIGS. 1*a* , 1*b* and 2, the distribution of a number of sections in a depth direction of the surface of the protective layer can be obtained by plotting a number of sections in a cut surface of the protective layer at various depth levels of the protective layer between the top of a maximum projection of the surface and the bottom of a maximum pit of the surface of the protective layer. The width of the distribution in which one or more sections are present in a cut surface means a depth of the rough surface of the protective layer, i.e., a distance from a bottom of a maximum pit to a top of a maximum projection of the protective layer. The shape of the distribution, i.e., a normal distribution or a deviated distribution, points to a state of the rough surface of the protective layer, namely points to whether the surface is a surface having uneven projections and pits or a surface having even projections and pits. To avoid measuring errors, the width of the distribution should be represented by a 95% confidence interval of the distribution. In addition, the maximum value of the number of sections in the distribution is approximately equal to the number of projections of the surface of the protective layer, namely, the more the maximum number of sections becomes, the more finely rough surface the protective layer has. To keep the 95% confidence interval of the distribution less than about 0.5 $\mu$m makes the cloudiness of the protective layer low, i.e., keeps the Haze factor of the protective layer less than about 40%. The maximum number of sections in the distribution is preferably controlled to be from about 100 to about 500 per 1000 $\mu m^2$ to maintain good transparency of the protective layer and good image qualities (particularly, without white streaks) of the images recorded on the thermosensitive recording material with thermal printheads. When the maximum number is greater than about 500 per 1000 $\mu m^2$, dust which comes to the thermal printhead during printing tends to stay there, resulting in occurrence of white streak images. In contrast, when the maximum number of sections is in the above-mentioned range, dust tends to pass through the thermal printhead with the surface of the feeding thermosensitive recording material, resulting in nonoccurrence of white streak images.

More preferably, the 95% confidence interval of the width of the distribution and the maximum number of sections are from about 0.2 to about 0.35 μm and from about 200 to about 400 per 1000 $\mu m^2$, respectively, to maintain high transparency and excellent image qualities. Detailed descriptions of methods for measuring these characteristics are mentioned later.

The protective layer is generally formed on a recording layer by coating a coating liquid including a resin and drying the coated liquid. In order to make a desirable microscopically rough surface, one or more following methods can be used:

(1) a filler is included in the protective layer;

(2) the surface of the protective layer is sand-blasted;

(3) a sheet having a rough surface is laminated on the protective layer and then peeled off;

(4) a roughened roller or a roughened sheet is pressed on the protective layer; and/or (5) a deep roughened surface is formed on the surface of a protective layer and then the surface is subjected to calender treatment to obtain a desired rough surface of the protective layer.

Among these methods, method (1) is preferable because of being a simple and inexpensive method.

A preferable filler for use in the protective layer includes an inorganic or an organic filler having an average particle diameter of less than about 1.0 μm, and preferably from about 0.1 to about 0.5 μm, to form a desired surface of the protective layer and to maintain good transparency of the thermosensitive recording material of the present invention. In addition, the dispersibility of the filler in the binder resin and the mixing ratio of the filler to the binder resin in the protective layer coating liquid need to be adjusted to prepare a protective layer having a desirable microscopically rough surface. To maintain good dispersion of the filler in a binder resin in the protective layer coating liquid, the coating liquid may be subjected to dispersing treatment such as ultrasonic treatment before or during a coating process. A filler having an average particle diameter more than 1.0 μm may be included in the protective layer if the protective layer has the desirable rough surface mentioned above.

Specific examples of such a filler include, but are not limited to:

inorganic filler phosphate fiber, potassium titanate, needle magnesium hydroxide, whiskers of inorganic compounds, talc, mica, glass flake, calcium carbonate, plate calcium carbonate, aluminum hydroxide, plate aluminum hydroxide, silica, clay, kaolin, sintered clay and hydrotalcite (or manasseite); and organic filler crosslinked polystyrene particles, urea-formaldehyde copolymer particles, silicone resin particles, crosslinked polymethyl methacrylate resin particles, guanamine-formaldehyde copolymer particles and melamine-formaldehyde copolymer particles.

These fillers can be employed alone or in combination.

Suitable resins for use in the protective layer include water-soluble resins, aqueous emulsions, hydrophobic resins, ultraviolet-light-crosslinkable resins and electron-beam-crosslinkable resins.

Specific examples of such a resin include, but are not limited to:

poly(meth)acrylate resins, polyvinyl butyral resins, polyvinyl acetoacetal resins, ethyl cellulose, methyl cellulose, cellulose acetate, hydroxyethyl cellulose, cellulose acetate propionate, polyurethane resins, polyester resins, polyvinyl acetate resins, polyvinyl chloride resins, styrene-acrylate copolymers, polyolefin resins, polystyrene resins, polyether resins, polyamide resins, polycarbonate resins, polyethylene resins, polypropylene resins and polyacrylamide resins.

The resin for use in the protective layer preferably has a refractive index which is from about 0.8 to about 1.2 times the refractive index of the transparent substrate, overlying which the protective layer is formed, to maintain high transparency of the transparent thermosensitive recording material.

In addition, the protective layer may include a crosslinking agent for crosslinking the resin included in the protective layer. Suitable crosslinking agents include known crosslinking agents useful for the above-mentioned resins.

In order to make a thermosensitive recording material having good ability to be used with thermal printheads, the kinetic friction coefficient of the surface of the protective layer is preferably controlled to be an appropriate value, for example, by one or more of the following methods:

(1) adding a wax and/or an oil to the protective layer;

(2) employing a silicone modified resin as a resin of the protective layer, if desired, together with other resin;

(3) adjusting the resin/filler mixing ratio; and/or (4) changing the composition of the filler.

Suitable waxes for use in the protective layer include stearic acid amide, palmitic acid amide, oleic acid amide, lauric acid amide, ethylenebisstearoamide, methylenebisstearoamide, methylolstearoamide, paraffin wax, polyethylene, carnauba wax, oxidized paraffin and zinc stearate. Suitable oils include silicone oil or the like.

The protective layer can be formed by a conventionally known manufacturing method as follows:

(1) dispersing a filler in a solvent or a resin solution using, for example, a ball mill to prepare a filler dispersing liquid;

(2) if desired, adding an additional resin solution to the filler dispersing liquid to prepare a protective layer coating liquid;

(3) coating the protective layer coating liquid on a recording layer using a conventionally known coating method; and (4) drying the coated liquid to form a protective layer.

The thickness of the protective layer is preferably from about 0.1 to about 20 μm, and more preferably from about 0.5 to about 10 μm to maintain good thermosensitivity and good preservability of the thermosensitive recording material, and good ability to be used with thermal printheads.

Suitable materials for use as the transparent substrate in the transparent thermosensitive recording material of the present invention include polyester films such as polyethylene terephthalate and polybutylene terephthalate; films of cellulose derivatives such as cellulose triacetate; polyolefin films such as polyethylene and polypropylene; polystyrene films; and laminated films thereof. The substrate for use in the transparent thermosensitive recording material of the present invention preferably has a Haze factor less than about 10%, and more preferably less than about 5% to make a thermosensitive recording material having good transparency.

The transparent thermosensitive recording material of the present invention includes one or more of the following recording layers:

(1) a recording layer which is able to change its color from colorless or pale-colored to colored upon application of heat thereto; and (2) a recording layer which is able to change its transparency upon application of heat thereto.

Specific examples of the recording layer (1) include:

(a) a recording layer which irreversibly forms a color image by a color forming reaction of a colorless or pale-colored leuco dye (electron donating dye precursor) with a coloring developer (electron accepting compound) upon application of heat or the like thereto;

(b) a recording layer which can reversibly form and erase a color image using a color forming reaction or a color erasing reaction of a colorless or pale-colored leuco dye (electron donating dye precursor) with a coloring developer (electron accepting compound) upon application of heat or the like thereto; and (c) a recording layer which can form an image by a reaction of an organic acid metal salt such as silver behenate and silver stearate with a reducing agent such as protocatechuic acid, spiroindane and hydroquinone.

Specific examples of the recording layer (2) include:

(d) a recording layer which can reversibly form and erase an image using an organic low-molecular-weight compound which is dispersed in a resin.

Among these recording layers, the recording layer (a) is preferable because of having good image qualities such as high black image density and good image stability, and having no metal therein which adversely affects the environment.

Next, the constituents constituting the recording layers of from (a) to (d) are described hereinafter.

Firstly, the constituents constituting the recording layers of (a) and (b) are described. The constituents constituting the recording layers (a) and (b) include a binder resin, a coloring agent and a coloring developer which forms a color image by reacting with the coloring agent upon application of heat or the like thereto. It depends on the combination of a coloring agent with a coloring developer used in the recording layer whether the recording layer can reversibly form and erase an image or only irreversibly forms an image.

Suitable coloring agents which can be used in the recording layer include electron donors. Any known colorless or pale-colored dye precursors conventionally used in thermosensitive recording materials can be employed alone or in combination. For example, leuco compounds such as triphenylmethanephthalide-, triarylmethane-, fluoran-, phenothiazine-, thiofluoran-, xanthene-, indophthalyl-, spiropyran-, azaphthalide-, chromenopyrazole-, methine-, rhodamineanilinolactam-, rhodaminelactam-, quinazoline-, diazaxanthene- and bislactone-type leuco compounds can preferably be employed.

Specific examples of useful leuco compounds include, but are not limited to:

2-anilino-3-methyl-6-diethylaminofluoran, 2-anilino-3-methyl-6-(di-n-butylamino)fluoran, 2-anilino-3-methyl-6-(N-n-propyl-N-methylamino) fluoran, 2-anilino-3-methyl-6-(N-isopropyl-N-methylamino) fluoran, 2-anilino-3-methyl-6-(N-isobutyl-N-methylamino) fluoran, 2-anilino-3-methyl-6-(N-n-amyl-N-methylamino) fluoran, 2-anilino-3-methyl-6-(N-sec-butyl-N-ethylamino) fluoran, 2-anilino-3-methyl-6-(N-n-amyl-N-ethylamino)fluoran, 2-anilino-3-methyl-6-(N-n-isoamyl-N-ethylamino) fluoran, 2-anilino-3-methyl-6-(N-n-propyl-N-isopropylamino) fluoran, 2-anilino-3-methyl-6-(N-cyclohexyl-N-methylamino) fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-3-methyl-6-diethylaminofluoran, 2-(m-trifluoromethylanilino)-3-methyl-6-(N-cyclohexyl-N-methylamino)fluoran, 2-(2,4-dimethylanilino)-3-methyl-6-diethylaminofluoran, 2-(N-ethyl-p-toluidino)-3-methyl-6-(N-ethylanilino) fluoran, 2-(N-methyl-p-toluidino)-3-methyl-6-(N-propyl-p-toluidino)fluoran, 2-anilino-6-(N-n-hexyl-N-ethylamino)fluoran, 2-(o-chloroanilino)-6-diethylaminofluoran, 2-(o-bromoanilino)-6-diethylaminofluoran, 2-(o-chloroanilino)-6-dibutylaminofluoran, 2-(o-fluoroanilino)-6-dibutylaminofluoran, 2-(m-trifluoromethylanilino)-6-diethylaminofluoran, 2-(p-acetylanilino)-6-(N-n-amyl-N-n-butylamino) fluoran, 2-benzylamino-6-(N-ethyl-p-toluidino)fluoran, 2-benzylamino-6-(N-methyl-2,4-dimethylanilino)fluoran, 2-benzylamino-6-(N-ethyl-2,4-dimethylanilino)fluoran, 2-benzylamino-6-(N-methyl-p-toluidino)fluoran, 2-benzylamino-6-(N-ethyl-p-toluidino)fluoran, 2-(di-p-methylbenzylamino)-6-(N-ethyl-p-toluidino) fluoran, 2-(α-phenylethylamino)-6-(N-ethyl-p-toluidino)fluoran, 2-methylamino-6-(N-methylanilino)fluoran, 2-methylamino-6-(N-ethylanilino)fluoran, 2-methylamino-6-(N-propylanilino)fluoran, 2-ethylamino-6-(N-methyl-p-toluidino)fluoran, 2-methylamino-6-(N-methyl-2,4-dimethylanilino) fluoran, 2-ethylamino-6-(N-methyl-2,4-dimethylanilino)fluoran, 2-dimethylamino-6-(N-methylanilino)fluoran, 2-dimethylamino-6-(N-ethylanilino)fluoran, 2-diethylamino-6-(N-methyl-p-toluidino)fluoran, 2-diethylamino-6-(N-ethyl-p-toluidino)fluoran, 2-dipropylamino-6-(N-methylanilino)fluoran, 2-dipropylamino-6-(N-ethylanilino)fluoran, 2-amino-6-(N-methylanilino)fluoran, 2-amino-6-(N-ethylanilino)fluoran, 2-amino-6-(N-propylanilino)fluoran, 2-amino-6-(N-methyl-p-toluidino)fluoran, 2-amino-6-(N-ethyl-p-toluidino)fluoran, 2-amino-6-(N-propyl-p-toluidino)fluoran, 2-amino-6-(N-methyl-p-ethylanilino)fluoran, 2-amino-6-(N-ethyl-p-ethylanilino)fluoran, 2-amino-6-(N-propyl-p-ethylanilino)fluoran, 2-amino-6-(N-methyl-2,4-dimethylanilino)fluoran, 2-amino-6-(N-ethyl-2,4-dimethylanilino)fluoran, 2-amino-6-(N-propyl-2,4-dimethylanilino)fluoran, 2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran,
1,2-benzo-6-dibutylaminofluoran,
1,2-benzo-6-(N-ethyl-N-cyclohexylamino)fluoran,
1,2-benzo-6-(N-ethyl-p-toluidino)fluoran,
2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-ethyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino) fluoran,
2-(α-phenylethylamino)-4-methyl-6-diethylaminofluoran,
2-(p-toluidino)-3-(t-butyl)-6-(N-methyl-p-toluidino) fluoran,
2-(o-methoxycarbonylanilino)-6-diethylaminofluoran,
2-acetylamino-6-(N-methyl-p-toluidino)fluoran,
3-diethylamino-6-(m-trifluoromethylanilino)fluoran,
4-methoxy-6-(N-ethyl-p-toluidino)fluoran,
2-ethoxyethylamino-3-chloro-6-dibutylaminofluoran,
2-benzylamino-4-chloro-6-(N-ethyl-p-toluidino)fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino) fluoran,
2-mesidino-4',5'-benzo-6-diethylaminofluoran,
2-(m-trifluoromethylanilino)-3-methyl-6-pyrrolidino fluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholino fluoran,
2-(di-N-p-chlorophenyl-methylamino)-6-pyrrolidino fluoran,
2-(N-n-propyl-m-trifluoromethylanilino)-6-morpholino fluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran,
benzoleucomethyleneblue,
2-{3,6-bis(diethylamino)}-6-(o-chloroanilino)xanthyl benzoic acid lactam,
2-{3,6-bis(diethylamino)}-9-(o-chloroanilino)xanthyl benzoic acid lactam,
3,3-bis(p-dimethylaminophenyl)phthalide,
3,3-bis(p-dimethylaminophenyl)-6-dimethylaminophthalide (i.e., crystal violet lactone)
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(2-methoxy-4-dimethylaminophenyl)-3-(2-hydroxy-4,5-dichlorophenyl)phthalide,
3-(2-hydroxy-4-dimethylaminophenyl)-3-(2-methoxy-5-chlorophenyl)phthalide,
3-(2-hydroxy-4-dimethoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3,6-bis(dimethylamino)fluorenespiro(9,3')-6'-dimethylaminophthalide,
6'-chloro-8'-methoxy-benzoindolino-spiropyran, and
6'-bromo-2'-methoxy-benzoindolino-spiropyran.

These compounds can be employed alone or in combination in the recording layer.

Suitable coloring developers which can be used in the recording layer of the transparent thermosensitive recording material of the present invention include known coloring developers such as electron acceptors conventionally used in thermosensitive recording materials. They can be employed alone or in combination. Preferred coloring developers are the electron acceptors having a long chain alkyl group which are disclosed, for example, in Japanese Laid-Open Patent Application No. 5-124360, incorporated herein by this reference. For example, organic phosphate compounds, aliphatic carboxylic acid compounds, phenolic compounds, each including an aliphatic group having 12 or more carbon atoms, metal salts of mercaptoacetic acid including an aliphatic group having from 10 to 18 carbon atoms, alkyl esters of caffeic acid having an alkyl group having from 5 to 8 carbon atoms, and acidic phosphate compounds including an aliphatic group having 16 or more carbon atoms are preferably employed. The above-mentioned aliphatic group includes a linear alkyl group, a branched alkyl group, a linear alkenyl group and a branched alkenyl group, and may include substituents of, for example, a halogen, an alkoxy group, an ester or the like.

Specific examples of such coloring developers include the following electron acceptors, but are not limited to:

(A) organic phosphate compounds

A preferred organic phosphate compound is represented by the following formula (1):

(1)

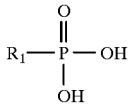

wherein $R_1$ represents a linear alkyl group having from 12 to 24 carbon atoms.

Specific examples of such compounds represented by the formula (1) are as follows:

dodecyl phosphonate,
tetradecyl phosphonate,
hexadecyl phosphonate,
octadecyl phosphonate,
eicosyl phosphonate,
docosyl phosphonate,
tetracosyl phosphonate,
hexacosyl phosphonate, and
octacosyl phosphonate.

Another preferred organic phosphate compound is an α-hydroxyalkyl phosphonate compound represented by the following formula (2):

(2)

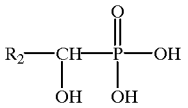

wherein $R_2$ represents an aliphatic group having from 11 to 29 carbon atoms.

Specific examples of such compounds represented by the formula (2) include the following α-hydroxyalkyl phosphonate:

α-hydroxydodecyl phosphonate,
α-hydroxytetradecyl phosphonate,
α-hydroxyhexadecyl phosphonate,
α-hydroxyoctadecyl phosphonate,
α-hydroxyeicosyl phosphonate,
α-hydroxydocosyl phosphonate, and
α-hydroxytetracosyl phosphonate.

Yet another preferred organic phosphate compound is an acidic organic phosphate compound represented by the following formula (3):

(3)

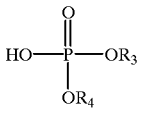

wherein $R_3$ represents an aliphatic group having 16 or more carbon atoms, and $R_4$ represents a hydrogen atom or an aliphatic group having one or more carbon atoms.

Specific examples of such compounds represented by the formula (3) include:

dihexadecyl phosphate,
dioctadecyl phosphate,
dieicosyl phosphate,
didocosyl phosphate,
monohexadecyl phosphate,
monooctadecyl phosphate,
monoeicosyl phosphate,
monodocosyl phosphate,
methyl hexadecyl phosphate,
methyl octadecyl phosphate,
methyl eicosyl phosphate,
methyl docosyl phosphate,
amyl hexadecyl phosphate,
octyl hexadecyl phosphate, and
lauryl hexadecyl phosphate.

(B) aliphatic carboxylic acid compounds

A preferred aliphatic carboxylic acid compound is an α-hydroxyaliphatic carboxylic acid compound represented by the following formula (4):

(4)

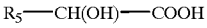

wherein $R_5$ represents an aliphatic group having 12 or more carbon atoms.

Specific examples of such compounds are as follows:

α-hydroxydecanoic acid,
α-hydroxytetradecanoic acid,
α-hydroxyhexadecanoic acid,
α-hydroxyoctadecanoic acid,
α-hydroxypentadecanoic acid,
α-hydroxyeicosanoic acid,
α-hydroxydocosanoic acid,
α-hydroxytetracosanoic acid,
α-hydroxyhexacosanoic acid, and
α-hydroxyoctacosanoic acid.

Another preferred aliphatic carboxylic acid compound is an aliphatic carboxylic acid compound which has an aliphatic group having 12 or more carbon atoms and a halogen in at least one of its α or β position carbon atoms.

Specific examples of such compounds are as follows:

2-bromohexadecanoic acid,
2-bromoheptadecanoic acid,
2-bromooctadecanoic acid,
2-bromoeicosanoic acid,
2-bromodocosanoic acid,
2-bromotetracosanoic acid,
3-bromooctadecanoic acid,
3-bromoeicosanoic acid,
2,3-dibromooctadecanoic acid,
2-fluorododecanoic acid,
2-fluorotetradecanoic acid,
2-fluorohexadecanoic acid,
2-fluorooctadecanoic acid,
2-fluoroeicosanoic acid,
2-fluorodocosanoic acid,
2-iodohexadecanoic acid,
2-iodooctadecanoic acid,
3-iodohexadecanoic acid,
3-iodooctadecanoic acid, and
perfluorooctadecanoic acid.

Yet another preferred aliphatic carboxylic acid compound is an aliphatic carboxylic acid compound which has an aliphatic group having 12 or more carbon atoms and an oxo group in at least one of its α, β or γ position carbon atoms.

Specific examples of such compounds are as follows:

2-oxododecanoic acid,
2-oxotetradecanoic acid,
2-oxohexadecanoic acid,
2-oxooctadecanoic acid,
2-oxoeicosanoic acid,
2-oxotetracosanoic acid,
3-oxododecanoic acid,
3-oxotetradecanoic acid,
3-oxohexadecanoic acid,
3-oxooctadecanoic acid,
3-oxoeicosanoic acid,
3-oxotetracosanoic acid,
4-oxohexadecanoic acid,
4-oxooctadecanoic acid, and
4-oxodocosanoic acid.

A further example of the preferred aliphatic carboxylic acid compounds is a dibasic carboxylic acid compound represented by the following formula (5):

(5)

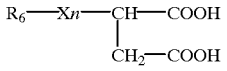

wherein $R_6$ represents an aliphatic group having 12 or more carbon atoms, X represents an oxygen atom or an sulfur atom, and n is 1 or 2.

Specific examples of such compounds are as follows:

dodecylmalic acid,
tetradecylmalic acid,
hexadecylmalic acid,
octadecylmalic acid,
eicosylmalic acid,
docosylmalic acid,
tetracosylmalic acid,
dodecylthiomalic acid,
tetradecylthiomalic acid,
hexadecylthiomalic acid,
octadecylthiomalic acid,
eicosylthiomalic acid,
docosylthiomalic acid,
tetracosylthiomalic acid,
dodecyldithiomalic acid,
tetradecyldithiomalic acid,
eicosyldithiomalic acid,
docosyldithiomalic acid, and
tetracosyldithiomalic acid.

A still further example of the preferred aliphatic carboxylic acid compounds is a dibasic carboxylic acid compound represented by the following formula (6):

(6)

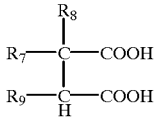

wherein $R_7$, $R_8$, and $R_9$ independently represent a hydrogen atom or an aliphatic group, and at least one of $R_7$, $R_8$ and $R_9$ is an aliphatic group having 12 or more carbon atoms.

Specific examples of such compounds are as follows:

dodecylbutanedioic acid,
tridecylbutanedioic acid,
tetradecylbutanedioic acid,
pentadecylbutanedioic acid,
octadecylbutanedioic acid,
eicosylbutanedioic acid,
docosylbutanedioic acid,
2,3-dihexadecylbutanedioic acid,
2,3-dioctadecylbutanedioic acid,
2-methyl-3-dodecylbutanedioic acid,
2-methyl-3-tetradecylbutanedioic acid,
2-methyl-3-hexadecylbutanedioic acid,
2-ethyl-3-dodecylbutanedioic acid,
2-propyl-3-dodecylbutanedioic acid,
2-octyl-3-hexadecylbutanedioic acid, and
2-tetradecyl-3-octadecylbutanedioic acid.

A still further example of the preferred aliphatic carboxylic acid compounds is a dibasic carboxylic acid compound represented by the following formula (7):

(7)

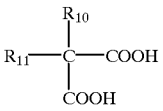

wherein $R_{10}$ and $R_{11}$ independently represent a hydrogen atom or an aliphatic group, and at least one of $R_{10}$ and $R_{11}$ is an aliphatic group having to 12 or more carbon atoms.

Specific examples of such compounds are as follows:

dodecylmalonic acid,
tetradecylmalonic acid,
hexadecylmalonic acid,
octadecylmalonic acid,
eicosylmalonic acid,
docosylmalonic acid,
tetracosylmalonic acid,
didodecylmalonic acid,
ditetradecylmalonic acid,
dihexadecylmalonic acid,
dioctadecylmalonic acid,
dieicosylmalonic acid,
didocosylmalonic acid,
methyloctadecylmalonic acid,
methyldocosylmalonic acid,
methyltetracosylmalonic acid,
ethyloctadecylmalonic acid,
ethyleicosylmalonic acid, ethyldocosylmalonic acid, and ethyltetracosylmalonic acid.

A still further example of the preferred aliphatic carboxylic acid compounds is a dibasic carboxylic acid compound represented by the following formula (8):

(8)

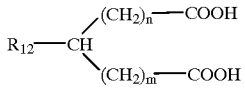

wherein $R_{12}$ represents an aliphatic group having 12 or more carbon atoms, n is 0 or 1, m is 1, 2 or 3, and provided when n is 0, m is 2 or 3, and provided when n is 1, m is 1 or 2.

Specific examples of such compounds are as follows:

2-dodecyl-pentanedioic acid, 2-hexadecyl-pentanedioic acid, 2-octadecyl-pentanedioic acid, 2-eicosyl-pentanedioic acid, 2-docosyl-pentanedioic acid, 2-dodecyl-hexanedioic acid, 2-pentadecyl-hexanedioic acid, 2-octadecyl-hexanedioic acid, 2-eicosyl-hexanedioic acid, and 2-docosyl-hexanedioic acid.

A still further example of the preferable aliphatic carboxylic acid compounds is a tribasic acid compound which is acylated by a long chain aliphatic acid.

Specific examples of such compounds are as follows:

(A)

o-palmitylcitric acid

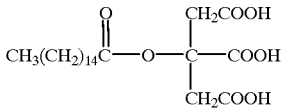

(B)

o-stearylcitric acid

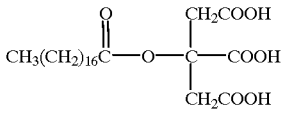

(C)

o-eicosylcitric acid

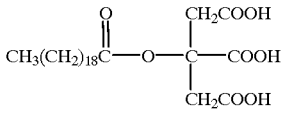

(C) phenolic compounds

A preferred phenolic compound is a phenolic compound represented by the following formula (9):

(9)

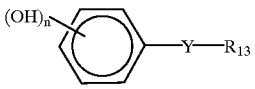

wherein Y represents —S—, —O—, —CONH— or —COO—, $R_{13}$ represents an aliphatic group having 12 or more carbon atoms and n is 1, 2 or 3.

Specific examples of such compounds are as follows:

p-(dodecylthio)phenol, p-(tetradecylthio)phenol,

P-(hexadecylthio)phenol,

P-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecylcarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, hexadecyl gallate, octadecyl gallate, eicosyl gallate, docosyl gallate, and tetracosyl gallate.

Another preferable phenolic compound is a caffeic acid alkyl ester represented by the following formula (10):

(10)

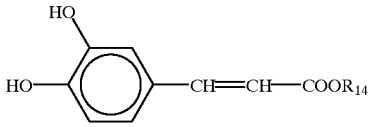

wherein $R_{14}$ represents an alkyl group having from 5 to 8 carbon atoms.

Specific examples of such compounds are as follows:

caffeic acid n-pentyl ester, caffeic acid n-hexyl ester, and caffeic acid n-octyl ester.

(D) metal salts of mercaptoacetic acid

A preferred metal salt of mercaptoacetic acid is a metal salt of alkyl- or alkenyl-mercaptoacetic acid represented by the following formula (11):

(11)

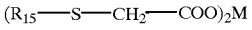

wherein $R_{15}$ represents an aliphatic group having from 10 to 18 carbon atoms, and M represents Sn, Mg, Zn or Cu.

Specific examples of such compounds are as follows:

Sn salt of decylmercaptoacetic acid,

Sn salt of dodecylmercaptoacetic acid,

Sn salt of tetradecylmercaptoacetic acid,

Sn salt of hexadecylmercaptoacetic acid,

Sn salt of octadecylmercaptoacetic acid,

Mg salt of decylmercaptoacetic acid,

Mg salt of dodecylmercaptoacetic acid,

Mg salt of tetradecylmercaptoacetic acid,

Mg salt of hexadecylmercaptoacetic acid,

Mg salt of octadecylmercaptoacetic acid,

Zn salt of decylmercaptoacetic acid,

Zn salt of dodecylmercaptoacetic acid,

Zn salt of tetradecylmercaptoacetic acid,

Zn salt of hexadecylmercaptoacetic acid,

Zn salt of octadecylmercaptoacetic acid,

Cu salt of decylmercaptoacetic acid,

Cu salt of dodecylmercaptoacetic acid,

Cu salt of tetradecylmercaptoacetic acid,

Cu salt of hexadecylmercaptoacetic acid, and

Cu salt of octadecylmercaptoacetic acid.

In the present invention, the coloring developer is not limited to the above-mentioned compounds and compounds can be employed which are conventionally used as a coloring developer in the thermosensitive recording material such as phenolic compounds, for example, 4,4'-isopropylidenebisphenol and 4, 4'-isopropylidenebis(o-methylphenol); and electron accepting compound such as salicylic acid, carboxylic acid type coloring developers and metal salt type coloring developers.

Among these coloring developers, organic phosphate compounds are preferable because of having good resistance to color formation caused by dissolving in a solvent of the protective layer coating liquid, good thermosensitivity, good image density and good ability to be used with thermal printheads.

These coloring developers are employed alone or in combination in the recording layer.

The content of the coloring developer is preferably from about 1 to about 20 parts by weight, and more preferably from about 2 to about 10 parts by weight, per 1 part by weight of the coloring agent in the thermosensitive coloring layer.

The coating solution of the protective layer often includes an organic solvent such as toluene, methyl ethyl ketone and alcohols which is used for dissolving a resin of the protective layer. When the organic solvent contacts the previously formed recording layer, undesired color formation occurs because the coloring agent and the coloring developer in the recording layer dissolve in the solvent and react to form a colored substance. In order to avoid this problem, one or more of the following methods can preferably be used:

(1) using a coloring agent and a coloring developer, at least one of which does not dissolve or hardly dissolves in the solvent used for the protective layer coating liquid;

(2) microencapsulating at least one of a coloring agent and a coloring developer to prevent the coloring agent from contacting the coloring developer; and/or (3) forming a resin layer between a recording layer and a protective layer to prevent the recording layer from contacting a protective layer coating liquid.

Next, the constituents constituting the aforementioned recording layer (c) which forms an image by a reaction of an organic acid metal salt with a reducing agent are described hereinafter.

Specific examples of such organic acid metal salts include a long chain aliphatic carboxylic acid silver salt such as silver laurate, silver myristate, silver palmitate, silver stearate, arachic acid silver salt and silver behenate; a silver salt of an organic compound having an imino group such as benzotriazole silver salt, benzimidazole silver salt, carbazole silver salt and phthalazinone silver salt; a silver salt of an organic compound having a sulfur atom such as s-alkyl thioglycolate silver salt; an aromatic carboxylic acid silver salt such as benzoic acid silver salt and phthalic acid silver salt; a sulfonic acid silver salt such as ethanesulfonic acid silver salt; sulfinic acid silver salt such as o-toluenesulfinic acid silver salt; a phosphonic acid silver salt such as phenylphosphonic acid silver salt; barbituric acid silver salt; saccharic acid silver salt; and salicylaldoxime silver salt. These compounds are employed alone or in combination.

Specific examples of such reducing agents include: phenolic compounds such as mono-, bis-, tris- or tetrakisphenolic compounds; naphthol compounds such as mono- or bisnaphthol compounds; hydroxynaphthalene compounds such as di- or polyhydroxynaphthalene compounds; hydroxybenzene compounds such as di- or polyhydroxybenzene; hydroxymonoether compounds; ascorbic acid compounds; 3-pyrazolidone compounds; pyrazoline compounds; pyrazolone compounds; reducing sugars; phenylenediamine compounds; hydroxylamine compounds; reductones; hydroxamic acid compounds; hydrazide compounds; amidoxime compounds; and N-hydroxyurea compounds.

Next, the constituents constituting the aforementioned recording layer (d) which reversely forms and erases an image using a low-molecular-weight organic compound dispersed in a resin are described hereinafter.

Specific examples of such resins include polyvinyl chloride, vinyl chloride-vinyl acetate copolymers, vinyl chloride-vinyl propionate copolymers, vinyl chloride-vinyl acetate-vinyl alcohol copolymers, vinyl chloride-vinyl acetate-maleic acid copolymers, vinyl chloride-acrylate copolymers, and copolymers of vinyl chloride and a vinyl ester of fatty acid having more than 3 carbon atoms. Preferably, the resin has a glass transition temperature of from about 40 to about 100° C.

The low-molecular-weight organic compounds include known organic compounds which are able to be dispersed in the above-mentioned resins, and have a melting point of from about 30 to about 200° C., and preferably from about 50 to about 150° C.

Specific examples of such low-molecular-weight organic compounds include fatty acid esters such as octadecyl palmitate, docosyl palmitate, heptyl stearate, octyl stearate, octadecyl stearate, docosyl stearate, octadecyl behenate, docosyl behenate or the like.

Suitable binder resins for use in the recording layers (a), (b) and (c) include known resins, such as polyacrylamide, maleic acid copolymers, polyacrylates, polymethacrylates, vinyl chloride-vinyl acetate copolymers, styrene copolymers, polyesters, polyurethanes, polyvinyl butyral, ethyl cellulose, polyvinyl acetal, polyvinyl acetoacetal, polycarbonate, epoxy resins and polyamides, but are not limited thereto.

The binder resin used in the recording layers (a), (b) and (c) preferably has a refractive index which is from about 0.8 to about 1.2 times the refractive index of the transparent substrate, overlying which the recording layer is formed, to maintain high transparency of the transparent thermosensitive recording material.

The preferable content of the binder resin in each recording layer is more than about 15 parts by weight, and more preferably about 25 to about 40 parts by weight, per 100 parts by weight of the total weight of the recording layer to maintain high transparency, good adhesion of the recording layer to the substrate, and good image qualities.

Specific examples of the recording layers of the transparent thermosensitive recording material of the present invention are described hereinbefore, but the recording layers are not limited thereto.

In addition, these recording layers may include auxiliary agents such as fillers, pigments, surfactants and thermofusible agents, if necessary.

Referring to manufacturing methods of the recording layers, the recording layers (a), (b) and (c) of the transparent thermosensitive recording material of the present invention can be formed, for example, by the following method:

(1) dispersing or dissolving a coloring agent, a coloring developer and a binder resin in water and/or an organic solvent to prepare a recording layer coating liquid;

(2) coating the recording layer coating liquid on a substrate by a conventionally known coating method; and (3) drying the coated liquid to form a recording layer.

The coloring agent and the coloring developer may be encapsulated, and in this case, the particle diameter of the capsules is preferably less than 1.0 μm to maintain high transparency and good image qualities such as good reproducibility of a fine image.

The preferred thickness of these recording layers, which depends on the formulation of the recording layer and the use of the thermosensitive recording material, is from about 1 to about 50 μm, and more preferably from about 3 to about 20 μm. If desired, the recording layer coating liquid may include additives such as a surfactant which improves the coating properties, thereby allowing the thermosensitive recording material to produce images having good image qualities.

The transparent thermosensitive recording material of the present invention may further include an intermediate layer containing a filler, a binder and a thermofusible material which is formed between the substrate and the recording layer to make the surface of the thermosensitive recording material smooth and to maintain good adhesion of the recording layer to the substrate.

In addition, the transparent thermosensitive recording material may include a back layer which is formed on the side opposite to the side on which the recording layer and the protective layer are formed and which prevents the transparent thermosensitive recording material from curling and/or electrostatic charging.

Suitable recording methods for recording images on the thermosensitive recording material of the present invention include any conventional recording methods using, for example, a thermal pen, a thermal printhead and laser beams.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Formation of recording layer)

A mixture of the following compounds was pulverized and dispersed in a ball mill in order that the average particle diameter of the solid components in the liquid was 0.3 μm (measured with a diffraction particle diameter measuring apparatus, HORIBA LA-700), to prepare a Liquid A, i.e., a recording layer coating liquid:

| (Liquid A) | |
|---|---|
| 2-anilino-3-methyl-6-diethylaminofluoran | 4 |
| octadecyl phosphonate | 12 |
| polyvinyl butyral (Denka Butyral #3000-2, manufactured by Denki Kagaku Kogyo K. K.) | 6 |
| toluene | 57 |
| methyl ethyl ketone | 57 |

The liquid A was coated on a substrate of a polyethylene terephthalate (PET) film (T-75, manufactured by Unitika Ltd.) having a thickness of 75 μm and a Haze factor of 3%, and dried to form a recording layer of 10 μm in a dry thickness.

(Formation of protective layer)

The following compounds were mixed and dispersed in a ball mill to prepare a Liquid B so that the average particle diameter of the melamine-formaldehyde copolymer particles was 0.2 μm:

| (Liquid B) | |
|---|---|
| melamine-formaldehyde copolymer particles (Epostar S, manufactured by Nippon Shokubai Co., Ltd., average particle diameter of 0.3 μm) | 30 |
| 10% polyvinyl acetoacetal resin solution (KS-1, manufactured by Sekisui Chemical Co., Ltd. was dissolved in methyl ethyl ketone) | 30 |
| methyl ethyl ketone | 140 |

The following compounds were mixed to prepare a Liquid C, i.e., a protective layer coating liquid:

| (Liquid C) | |
|---|---|
| Liquid B | 150 |
| silicone modified polyvinyl butyral resin (SP-712, manufactured by Dainichiseika Color & Chemical Mfg. Co., Ltd., solid content of 12.5%) | 45 |
| 10% polyvinyl acetoacetal resin solution (KS-1, manufactured by Sekisui Chemical Co., Ltd., was dissolved in methyl ethyl ketone) | 34 |
| methyl ethyl ketone | 109 |

The liquid C was subjected to ultrasonic treatment for 15 minutes, and then coated on the previously prepared recording layer and dried to form a protective layer of 1.5 μm in a dry thickness. Thus, a transparent thermosensitive recording material of the present invention was obtained.

Example 2

(Formation of recording layer)

The procedure for preparation of the recording layer in Example 1 was repeated to obtain a recording layer formed on a PET film.

(Formation of protective layer)

The following compounds were mixed to prepare a Liquid D, i.e., a protective layer coating liquid:

| (Liquid D) | |
|---|---|
| Liquid B | 75 |
| silicone modified polyvinyl butyral resin (SP-712, manufactured by Dainichiseika Color & Chemical Mfg. Co., Ltd., solid content of 12.5%) | 45 |
| 10% polyvinyl acetoacetal resin solution | 45 |

-continued

| (Liquid D) | |
|---|---|
| (KS-1, manufactured.by Sekisui Chemical Co., Ltd. was dissolved in methyl ethyl ketone) | |
| methyl ethyl ketone | 60 |

The liquid D was subjected to ultrasonic treatment for 15 minutes, and then coated on the previously prepared recording layer and dried to form a protective layer of 1.5 μm in a dry thickness. Thus, a transparent thermosensitive recording material of the present invention was obtained.

Example 3

(Formation of recording layer)

The procedure for preparation of the recording layer in Example 1 was repeated to obtain a recording layer formed on a PET film.

(Formation of protective layer)

The following compounds were mixed and dispersed in a ball mill to prepare a Liquid E so that the average particle diameter of the melamine-formaldehyde copolymer particles was 0.3 μm:

| (Liquid E) | |
|---|---|
| melamine-formaldehyde copolymer particles (Epostar S, manufactured by Nippon Shokubai Co., Ltd., average particle diameter of 0.3 μm) | 30 |
| 10% acrylic resin solution (BR73, manufactured by Mitsubishi Rayon Co., Ltd., was dissolved in methyl ethyl ketone) | 30 |
| methyl ethyl ketone | 140 |

The following compounds were mixed to prepare a liquid F, i.e., a protective layer coating liquid:

| (Liquid F) | |
|---|---|
| Liquid E | 75 |
| silicone modified polyvinyl butyral resin (SP-712, manufactured by Dainichiseika Color & Chemical Mfg. Co., Ltd., solid content of 12.5%) | 45 |
| 10% acrylic resin solution (BR73, manufactured by Mitsubishi Rayon Co., Ltd., was dissolved in methyl ethyl ketone) | 45 |
| methyl ethyl ketone | 60 |

The liquid F was subjected to ultrasonic treatment for 15 minutes, and then coated on the previously prepared recording layer and dried to form a protective layer of 1.5 μm in a dry thickness. Thus, a transparent thermosensitive recording material of the present invention was obtained.

Example 4

(Formation of recording layer)

The procedure for preparation of the recording layer in Example 1 was repeated to obtain a recording layer formed on a PET film except that the polyester film was replaced with S-75 which was manufactured by Unitika Ltd. and whose Haze factor was 6%.

(Formation of protective layer)

The following compounds were mixed and dispersed in a ball mill to prepare a Liquid G so that the average particle diameter of the particles of the kaolin powder was 0.4 μm:

| (Liquid G) | |
|---|---|
| kaolin powder (ASP-170, manufactured by Engelhard Corp.) | 30 |
| 5% polyvinyl acetoacetal resin solution (KS-5, manufactured by Sekisui Chemical Co., Ltd. was dissolved in methyl ethyl ketone) | 60 |
| methyl ethyl ketone | 110 |

The following compounds were mixed to prepare a liquid H, i.e., a protective layer coating liquid:

| (Liquid H) | |
|---|---|
| Liquid G | 225 |
| silicone modified polyvinyl butyral resin (SP-712, manufactured by Dainichiseika Color & Chemical Mfg. Co., Ltd., solid content of 12.5%) | 27 |
| 5% polyvinyl acetoacetal resin solution (KS-5, manufactured by Sekisui Chemical Co., Ltd. was dissolved in methyl ethyl ketone) | 90 |
| methyl ethyl ketone | 93 |

The liquid H was subjected to ultrasonic treatment for 15 minutes, and then coated on the previously prepared recording layer and dried to form a protective layer of 1.5 μm in a dry thickness. Thus, a transparent thermosensitive recording material of the present invention was obtained.

Example 5

(Formation of recording layer)

The procedure for preparation of the recording layer in Example 1 was repeated to obtain a recording layer formed on a PET film.

(Formation of protective layer)

The following compounds were mixed and dispersed in a ball mill to prepare a Liquid I so that the average particle diameter of the particles of the silica powder was 0.2 μm:

| (Liquid I) | |
|---|---|
| silica powder (Mizukasil P-832, manufactured by Mizusawa Industrial Chemicals Ltd.) | 30 |
| silicone modified polyvinyl butyral resin (SP-712, manufactured by Dainichiseika Color & Chemical Mfg. Co., Ltd., solid content of 12.5%) | 24 |
| methyl ethyl ketone | 146 |

The following compounds were mixed to prepare a liquid J, i.e., a protective layer coating liquid:

| (Liquid J) | |
|---|---|
| Liquid I | 75 |
| silicone modified polyvinyl butyral resin (SP-712, manufactured by Dainichiseika Color & Chemical Mfg. Co., Ltd., solid content of 12.5%) | 90 |
| methyl ethyl ketone | 72 |

The liquid J was coated on the previously prepared recording layer, and dried to form a protective layer of 1.5 μm in a dry thickness. Thus, a transparent thermosensitive recording material of the present invention was obtained.

Example 6

The procedure for preparation of the transparent thermosensitive recording material in Example 5 was repeated except that a back layer was formed on the side of the PET film opposite to the side on which the recording layer and the protective layer were to be formed so that the Haze factor of the PET film having the back layer was 20%. Thus, a transparent thermosensitive recording material of the present invention was obtained.

Example 7

(Formation of recording layer)

The procedure for preparation of the recording layer in Example 1 was repeated to obtain a recording layer formed on a PET film.

(Formation of protective layer)

The following compounds were mixed to prepare a Liquid K, i.e., a protective layer coating liquid:

| (Liquid K) | |
|---|---|
| ultraviolet-light-crosslinkable urethane-acrylate resin (butyl acetate solution, solid content of 75%) | 100 |
| ethyl acetate | 50 |
| polyether modified dimethylpolysiloxane (BYK-344, manufactured by BYK-Chemie Co., xylene/isobutanol solution, solid content of 52%) | 4 |

The Liquid K was coated on the previously prepared recording layer, dried and irradiated with ultraviolet light so that the protective layer was crosslinked to the extent that the surface of the protective layer was not tacky. The thickness of the protective layer was 1.5 μm in a dry thickness.

The obtained protective layer was then pressed with a roll having a rough surface and further irradiated with ultraviolet light to form a roughened protective layer which was sufficiently crosslinked.

Thus, a transparent thermosensitive recording material of the present invention was obtained.

Example 8

(Formation of recording layer)

The procedure for preparation of the recording layer in Example 1 was repeated to obtain a recording layer formed on a PET film.

(Formation of protective layer)

The following compounds were mixed and dispersed in a ball mill to prepare a Liquid L so that the average particle diameter of the particles of the polymethyl methacrylate was 0.12 μm:

| (Liquid L) | |
|---|---|
| crosslinked polymethyl methacrylate particles (RCP-6, manufactured by Nippon Paint Co., Ltd. | 30 |
| 10% polyvinyl acetoacetal resin (KS-1, manufactured by Sekisui Chemical Co., Ltd., was dissolved in methyl ethyl ketone) | 30 |
| methyl ethyl ketone | 140 |

The following compounds were mixed to prepare a liquid M, i.e., a protective layer coating liquid:

| (Liquid M) | |
|---|---|
| Liquid L | 150 |
| silicone modified polyvinyl butyral resin (SP-712, manufactured by Dainichiseika Color & Chemical Mfg. Co., Ltd., solid content of 12.5%) | 45 |
| 10% polyvinyl acetoacetal resin (KS-1, manufactured by Sekisui Chemical Co., Ltd., was dissolved in methyl ethyl ketone) | 34 |
| methyl ethyl ketone | 109 |

The liquid M was subjected to ultrasonic treatment for 15 minutes, and then coated on the previously prepared recording layer and dried to form a protective layer of 1.5 μm in a dry thickness. Thus, a transparent thermosensitive recording material of the present invention was obtained.

Example 9

(Formation of recording layer)

The procedure for preparation of the recording layer in Example 1 was repeated to obtain a recording layer formed on a PET film.

(Formation of protective layer)

The following compounds were mixed to prepare a liquid N, i.e., a protective layer coating liquid:

| (Liquid N) | |
|---|---|
| Liquid L | 226 |
| silicone modified polyvinyl butyral resin (SP-712, manufactured by Dainichiseika Color & Chemical Mfg. Co.,Ltd., solid content of 12.5%) | 45 |
| 10% polyvinyl acetoacetal resin (KS-1, manufactured by Sekisui Chemical Co., Ltd., was dissolved in methyl ethyl ketone) | 23 |
| methyl ethyl ketone | 158 |

The liquid N was subjected to ultrasonic treatment for 15 minutes, and then coated on the previously prepared recording layer and dried to form a protective layer of 1.5 μm in a dry thickness. Thus, a transparent thermosensitive recording material of the present invention was obtained.

Example 10

(Formation of recording layer)

The procedure for preparation of the recording layer in Example 1 was repeated to obtain a recording layer formed on a PET film.

(Formation of protective layer)

The following compounds were mixed to prepare a liquid O, i.e., a protective layer coating liquid:

| (Liquid O) | |
|---|---|
| Liquid B | 188 |
| silicone modified polyvinyl butyral resin (SP-712, manufactured by Dainichiseika Color & Chemical Mfg. Co., Ltd., solid content of 12.5%) | 45 |
| 10% polyvinyl acetoacetal resin (KS-1, manufactured by Sekisui Chemical Co., Ltd., was dissolved in methyl ethyl ketone) | 29 |
| methyl ethyl ketone | 133 |

The liquid O was subjected to ultrasonic treatment for 15 minutes, and then coated on the previously prepared recording layer and dried to form a protective layer of 1.5 μm in a dry thickness. Thus, a transparent thermosensitive recording material of the present invention was obtained.

Comparative Example 1

The procedure for preparation of the transparent thermosensitive recording material in Example 4 was repeated except that the protective layer coating liquid, i.e., Liquid H, was coated without being subjected to ultrasonic treatment.

Thus, a comparative transparent thermosensitive recording material was obtained.

Comparative Example 2

(Formation of recording layer)

The procedure for preparation of the recording layer in Example 6 was repeated to prepare a PET film (T-75) having a back layer and a recording layer.

(Formation of protective layer)

The following compounds were mixed and dispersed in a ball mill to prepare a Liquid P so that the average particle diameter of the guanamine-formaldehyde copolymer particles was 3.2 μm:

| (Liquid P) | |
|---|---|
| guanamine-formaldehyde copolymer particles (Epostar M-30, manufactured by Nippon Shokubai Co., Ltd.) | 30 |
| 10% acrylic resin solution (BR73, manufactured by Mitsubishi Rayon Co., Ltd., was dissolved in methyl ethyl ketone) | 30 |
| methyl ethyl ketone | 140 |

The following compounds were mixed to prepare a liquid Q, i.e., a protective layer coating liquid:

| (Liquid Q) | |
|---|---|
| Liquid P | 8 |
| 10% acrylic resin solution (BR-73, manufactured by Mitsubishi Rayon Co., Ltd., was dissolved in methyl ethyl ketone) | 120 |
| methyl ethyl ketone | 5 |

The liquid Q was coated on the previously prepared recording layer without being subjected to ultrasonic treatment and dried to form a protective layer of 1.5 μm in a dry thickness. Thus, a comparative transparent thermosensitive recording material was obtained.

Comparative Example 3

(Formation of recording layer)

The procedure for preparation of the recording layer in Example 6 was repeated to prepare a PET film (T-75) having a back layer and a recording layer.

(Formation of protective layer)

The following compounds were mixed to prepare a Liquid R, i.e., a protective layer coating liquid:

| (Liquid R) | |
|---|---|
| silicone modified polyvinyl butyral resin (SP-712, manufactured by Dainichiseika Color & Chemical Mfg. Co., Ltd., solid content of 12.5%) | 70 |
| methyl ethyl ketone | 40 |

The liquid R was coated on the previously prepared recording layer and dried to form a protective layer of 1.5 μm in a dry thickness. Thus, a comparative transparent thermosensitive recording material was obtained.

Comparative Example 4

The procedure for preparation of the transparent thermosensitive recording material in Example 7 was repeated except that the pressing roller having a rough surface was replaced with a pressing roller having a different type of rough surface.

Thus, a comparative transparent thermosensitive recording material was obtained.

Comparative Example 5

(Formation of recording layer)

The procedure for preparation of the recording layer in Example 1 was repeated to obtain a recording layer formed on a PET film.

(Formation of protective layer)

The following compounds were mixed to prepare a liquid S, i.e., a protective layer coating liquid:

| (Liquid S) | |
|---|---|
| Liquid B | 23 |
| silicone modified polyvinyl butyral resin (SP-712, manufactured by Dainichiseika Color & Chemical Mfg. Co., Ltd., solid content of 12.5%) | 45 |
| 10% polyvinyl acetoacetal resin (KS-1, manufactured by Sekisui Chemical Co., Ltd., was dissolved in methyl ethyl ketone) | 54 |
| methyl ethyl ketone | 26 |

The liquid S was subjected to ultrasonic treatment for 15 minutes, and then coated on the previously prepared recording layer and dried to form a protective layer of 1.5 μm in a dry thickness. Thus, a comparative transparent thermosensitive recording material was obtained.

Comparative Example 6

(Formation of recording layer)

The procedure for preparation of the recording layer in Example 1 was repeated to obtain a recording layer formed on a PET film.

(Formation of protective layer)

The following compounds were mixed to prepare a liquid T, i.e., a protective layer coating liquid:

| (Liquid T) | |
|---|---|
| Liquid G | 150 |
| silicone modified polyvinyl butyral resin (SP-712, manufactured by Dainichiseika Color & Chemical Mfg. Co., Ltd., solid content of 12.5%) | 45 |
| 5% polyvinyl acetoacetal resin (KS-5, manufactured by Sekisui Chemical Co., Ltd., was dissolved in methyl ethyl ketone) | 68 |
| methyl ethyl ketone | 75 |

The liquid T was coated on the previously prepared recording layer without being subjected to ultrasonic treatment and dried to form a protective layer of 1.5 μm in a dry thickness. Thus, a comparative transparent thermosensitive recording material was obtained.

The obtained thermosensitive recording materials of Examples 1 to 10 and Comparative Examples 1 to 6 were evaluated by the following methods.

(1) transparency (Haze factor)

Haze factor of each transparent thermosensitive recording material was measured by a method based on JIS 7105 using a direct reading Haze meter manufactured by Suga Test Instruments Co., Ltd.

(2) physical properties of surface (95% confidence interval of distribution of number of sections and maximum number of sections)

The surface of the protective layer of each transparent thermosensitive recording material was analyzed with a three dimensional surface analyzer, ERA-8000FE manufactured by ELIONIX Co. The 95% confidence interval of a distribution of number of sections and the maximum number of sections were obtained from the distribution chart of the number of sections obtained when the surface of the protective layer of each transparent thermosensitive recording material was microscopically and horizontally cut 41 times at equally spaced intervals between a top of a maximum projection of the surface and a bottom of a maximum pit of the surface of the protective layer. The magnification of the measurement was 3000. An example of the distribution chart of the number of sections is shown in FIG. 2.

(3) white streaks

Each transparent thermosensitive recording material was set in a thermal recording simulator manufactured by Ohkura Electric Co., Ltd. and three solid images were recorded using the following recording conditions:

dot density of the thermal printhead used: 8 dots/mm applied electric power: 0.68 W/dot cycle time: 10 msec/line pulse width: 0.30 msec recording length: 30 cm recording width: 20 cm Total number of white streaks in the three solid images was counted and divided by three to obtain the number of white streaks per one solid image.

(4) sticking

The image recording procedure for evaluation of white streaks was repeated except that the pulse width was 0.5 msec.

Noise caused by sticking of each thermosensitive recording material to the thermal printhead during image recording was evaluated and classified as follows:

◎: no sticking noise was made

○: little sticking noise was made

Δ: a little sticking noise was made

X: harsh sticking noise was made

The results are shown in Table 1.

TABLE 1

| | 95% confidence interval (μm) | maximum number of sections | Haze factor (%) | white streak | sticking |
|---|---|---|---|---|---|
| Example 1 | 0.26 | 330 | 20 | 0 | ◎ |
| Example 2 | 0.19 | 150 | 15 | 2 | ○ |
| Example 3 | 0.45 | 130 | 28 | 2 | ○ |
| Example 4 | 0.40 | 160 | 18 | 4 | ○ |
| Example 5 | 0.30 | 230 | 12 | 0 | ◎ |
| Example 6 | 0.30 | 230 | 30 | 0 | ◎ |
| Example 7 | 0.15 | 180 | 10 | 3 | ○ |
| Example 8 | 0.14 | 470 | 15 | 4 | ○ |
| Example 9 | 0.13 | 410 | 13 | 3 | ○ |
| Example 10 | 0.28 | 385 | 23 | 0 | ◎ |
| Comparative Example 1 | 0.80 | 150 | 50 | 6 | ○ |
| Comparative Example 2 | 2.10 | 20 | 40 | 8 | X |
| Comparative Example 3 | 0.00 | 0 | 22 | 20 | Δ |
| Comparative Example 4 | 0.10 | 530 | 10 | 18 | Δ |
| Comparative Example 5 | 0.10 | 80 | 6 | 15 | Δ |
| Comparative Example 6 | 0.60 | 120 | 43 | 12 | Δ |

The results in Table 1 clearly indicate that the transparent thermosensitive recording materials of the present invention have high transparency and good ability to be used with the thermal printhead, and exhibit good image qualities.

Particularly, the transparent thermosensitive recording materials of Examples 1, 5, 6 and 10 have excellent ability to be used with the thermal print head and exhibit excellent image qualities.

Additional modifications and variations of the present invention are possible in light of the above teachings. It is therefore to be understood that within the scope of the appended claims the invention may be practiced other than as specifically described herein.

This application is based on Japanese Patent Application No. 08-298127, filed on Oct. 22, 1996, the entire contents of which are herein incorporated by reference.

What is claimed is:

1. A transparent thermosensitive recording material which comprises a transparent substrate, a thermosensitive recording layer formed overlying the substrate, and a protective layer which is formed overlying the thermosensitive recording layer and which comprises a resin, wherein the protective layer has a microscopically rough surface comprising projections including a maximum projection having a top and pits including a maximum pit having a bottom, such that when said surface is oriented horizontally and is horizontally cut in a plane at any level in a depth direction of said surface between said top and said bottom, the plane of cutting contains a number of sections of projections equal to the number of projections intersected by cutting at said level, and wherein said microscopically rough surface is a surface in which a 95% confidence interval of a distribution of a number of sections in said depth direction is less than about 0.5 μm and a maximum number of sections in the distribution of the number of sections is from about 100 to about 500 per 1000 $\mu m^2$ when said surface is horizontally cut 41 times at equally spaced intervals between said top and said bottom.

2. The transparent thermosensitive recording material of claim 1, wherein the 95% confidence interval of the distribution of the number of sections in the depth direction of the surface of the protective layer is from about 0.20 to about 0.35 μm and the maximum number of sections is from about 200 to about 400 per 1000 $\mu m^2$.

3. The transparent thermosensitive recording material of claim 2, wherein the thermosensitive recording layer comprises (a) one of a colorless leuco compound and a pale-colored leuco compound, (b) a coloring developer which induces color formation by reacting with the leuco compound upon application of heat, and (c) a binder resin.

4. The transparent thermosensitive recording material of claim 2, wherein the transparent substrate has a Haze factor less than about 10%.

5. The transparent thermosensitive recording material of claim 2, wherein the protective layer further comprises a particulate filler having an average particle diameter of from about 0.1 to about 0.5 μm.

6. The transparent thermosensitive recording material of claim 1, wherein the thermosensitive recording layer comprises (a) one of a colorless leuco compound and a pale-colored leuco compound, (b) a coloring developer which induces color formation by reacting with the leuco compound upon application of heat, and (c) a binder resin.

7. The transparent thermosensitive recording material of claim 6, wherein each of the transparent substrate and the binder resin in the thermosensitive recording layer has a refractive index, and wherein the refractive index of the binder resin is from about 0.8 to about 1.2 times the refractive index of the transparent substrate.

8. The transparent thermosensitive recording material of claim 6, wherein the binder resin is present in the thermosensitive recording layer in an amount of from about 25 to about 40 parts by weight per 100 parts by weight of the thermosensitive recording layer.

9. The thermosensitive recording material of claim 6, wherein the ratio of the coloring agent to the coloring developer in the thermosensitive recording layer is from about 1:2 to about 1:10 by weight.

10. The transparent thermosensitive recording material of claim 1, wherein the transparent substrate has a Haze factor less than about 10%.

11. The transparent thermosensitive recording material of claim 1, wherein the protective layer further comprises a particulate filler having an average particle diameter of from about 0.1 to about 0.5 $\mu$m.

12. The transparent thermosensitive recording material of claim 1, wherein the transparent thermosensitive recording material has a Haze factor less than about 40%.

13. The transparent thermosensitive recording material of claim 1, wherein the thermosensitive recording layer comprises a binder resin and a low-molecular-weight organic compound which is dispersed in the resin.

14. The transparent thermosensitive recording material of claim 1, wherein each of the transparent substrate and the resin in the protective layer has a refractive index, and wherein the refractive index of the resin is from about 0.8 to about 1.2 times the refractive index of the transparent substrate.

15. The transparent thermosensitive recording material of claim 1, wherein the resin in the protective layer comprises a silicone modified resin.

16. The thermosensitive recording material of claim 1, wherein the protective layer has a thickness of from about 0.5 to about 10 $\mu$m.

17. The thermosensitive recording material of claim 1, wherein the thermosensitive recording layer has a thickness of from about 3 to about 20 $\mu$m.

* * * * *